United States Patent [19]

Torgerson

[11] 4,045,611

[45] Aug. 30, 1977

[54] HERMETIC LEAD WIRE

[75] Inventor: Duane E. Torgerson, Oswego, Ill.

[73] Assignee: Belden Corporation, Geneva, Ill.

[21] Appl. No.: 618,035

[22] Filed: Sept. 30, 1975

[51] Int. Cl.[2] ..... H01B 7/02

[52] U.S. Cl. ..... 174/121 SR; 174/110 PM; 174/121 R

[58] Field of Search ..... 174/121 R, 121 SR, 110 PM, 174/122 R; 310/71

[56] References Cited

U.S. PATENT DOCUMENTS

| | | | |
|---|---|---|---|
| 2,691,694 | 10/1954 | Young | 174/121 R |
| 3,427,394 | 2/1969 | McKean | 174/121 R |
| 3,914,495 | 10/1975 | Lania | 174/121 SR |

FOREIGN PATENT DOCUMENTS

| | | | |
|---|---|---|---|
| 723,075 | 12/1965 | Canada | 174/121 SR |

*Primary Examiner*—E. A. Goldberg

*Attorney, Agent, or Firm*—Fitch, Even, Tabin & Luedeka

[57] ABSTRACT

A hermetic lead wire for use in conducting electricity to a motor in a hermetically sealed system such as a refrigeration system is formed with an electrically wound, laminated flexible foil tape surrounding an internal stranded conductor. The laminated tape is formed with an inner nonwoven fibrous layer of polyester fibers for interlocking with the conductor when melted by a hot stripping tool. An outer impervious foil layer of polyester on said laminated tape provides a dielectric shield for the wire. Preferably, the laminated tape is helically wound about the conductor and is covered with an outer flexible braided sheath of polyester filaments.

6 Claims, 3 Drawing Figures

HERMETIC LEAD WIRE

This invention relates to an electrical lead wire and more particularly to a lead wire used to conduct electricity to a motor in a hermetically sealed system such as a refrigeration system.

Hermetic lead wires used in refrigeration systems are exposed directly to the refrigeration fluid such as liquid and/or gaseous Freon. The motors in the systems tend to vibrate particularly during the start-up of the motor, and they flex the lead wire subjecting the same to breaking, if the wire cannot withstand such vibrations being imparted to it. Because the system is hermetically sealed, it is most important that the hermetic lead wire experience a long life.

A conventional hermetic lead wire used heretofore in refrigeration systems was formed with an inner, multi-stranded conductor for conducting the electricity and other multi-layered insulating layer having an inner woven layer or sleeve of braided polyester sold under the trademark "Dacron" wrapped about the conductor. This inner braided Dacron layer provided abrasion resistance and functioned to secure insulation to the conductor when a hot wire stripping blade was used to sever a piece of the insulation from the lead wire at the time of connecting the inner conductor to the motor. More specifically, the portion of the inner braided Dacron layer, which was melted, gripped the inner conductor and held an outer polyester tape sold under the trademark "Mylar," and an outer braided sheath of Dacron against slipping along the conductor. After the inner stranded conductor was connected to the motor, the motor and the adjacent portion of the hermetic lead wire were dipped into a varnish or other type of potting material and then baked.

While such conventional hermetic lead wires are generally satisfactory, it has been noted that the inner Dacron braided layer tends to wick varnish and this results in an area of solidified varnish on the conductor and an area of rigidity in the lead wire after the baking process. Because the polyester filaments are wound under tension and are stressed when forming the inner braided sleeve, these braided filaments contract during the baking process and add a further unwanted rigidity to the flexible hermetic lead wire.

In addition to the necessity for being very flexible and to meeting necessary electrical specifications including a preferred dielectric insulation, the lead wires also must be clean in the sense that they will not contaminate the refrigeration fluid such as Freon. Thus, many systems will not tolerate use of plastic materials other than polyester, although it has been known to add a Teflon foil to a conventional hermetic lead wire of this kind. Also, another problem with the aforementioned construction of hermetic lead wire is that oil or other soluble materials tended to accumulate on the wire during the braiding operations. An accumulation in excess of an acceptable standard, for example, 0.03 grams of soluble material per pound of insulation, results in a scrapping of these hermetic lead wires. Typically, because of the relatively slow braiding operations and a relatively high scrap rate, hermetic lead wires have been relatively expensive when compared to other kinds of lead wires which are not subject to such rigorous requirements.

Accordingly, an object of the present invention is to provide a new and improved, as contrasted to the conventional, hermetic lead wire.

Other objects and advantages of the invention will become apparent from the following detailed description taken in connection with the drawings in which.

Figure 1:
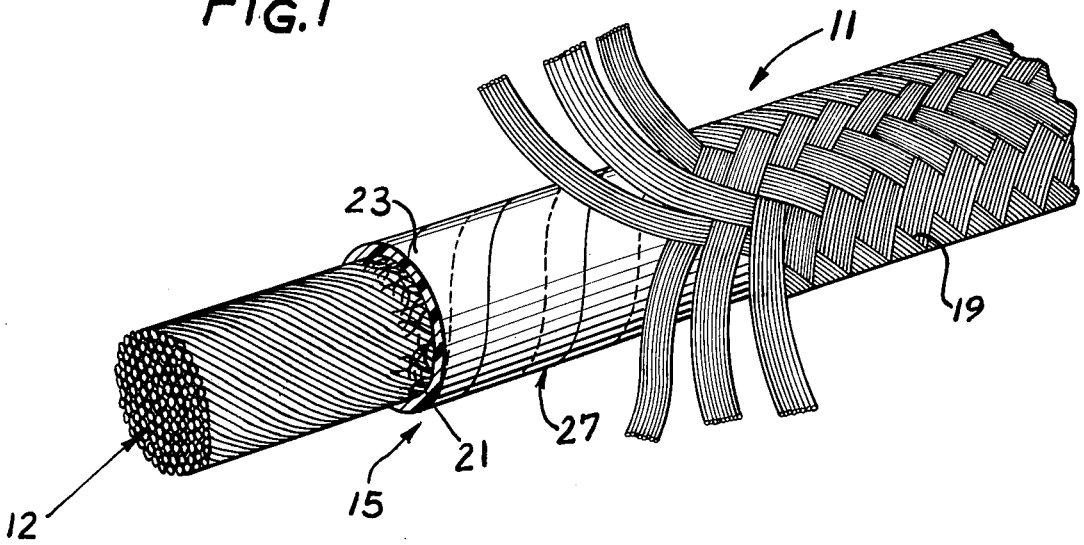
FIG. 1 is a perspective view of a hermetic lead wire constructed in accordance with the preferred embodiment of the invention.
Figure 2:
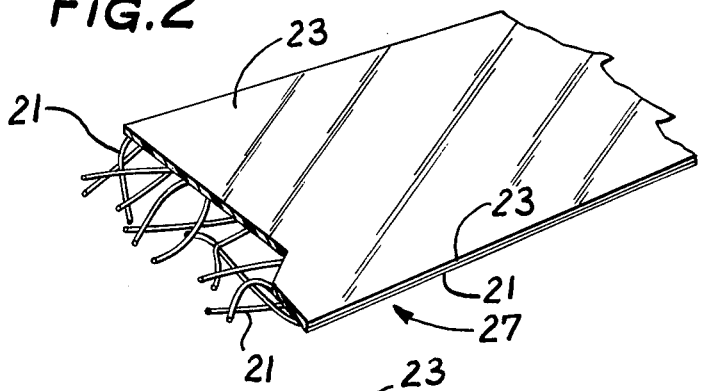
FIG. 2 is an enlarged diagrammatic view of a laminated tape for use with the wire of FIG. 1.
Figure 3:
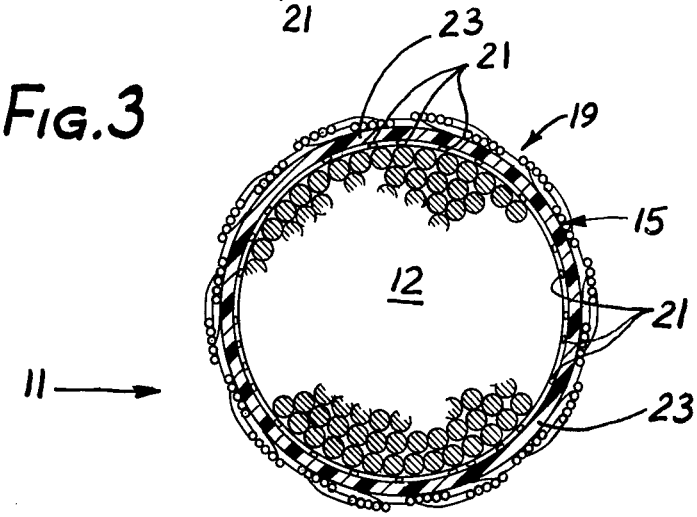
FIG. 3 is an enlarged cross-sectional view of the wire of FIG. 1.

As shown in the drawings for purposes of illustration, the invention is embodied in a hermetic lead wire 11 having an internal stranded metallic conductor 12 for carrying electrical current. Surrounding the internal conductor is a multi-layered insulating means 15 which serves to provide dielectric strength, abrasion resistance, physical strength, and interlock with the stranded conductor, when a wire stripping tool is used to strip a portion of the insulating jacket from the conductor 12. The multi-layered insulating means 15 comprises an outer sheath 19 of insulating material such as a braided sleeve of polyester, i.e., Dacron.

In the conventional hermetic lead wires, an inner braided Dacron layer or sleeve of generally the same construction as the outer Dacron sleeve 19, shown in FIG. 1, surrounded the inner conductor and a Mylar foil tape surrounded the inner Dacron braided sleeve with an outer braided Dacron sleeve providing the external protection for the Mylar tape. As explained above, the inner Dacron sleeve tended to wick varnish, and to contract and tighten on the internal conductor during the baking of the varnish which encapsulated the motor. Furthermore, the braiding of the polyester filaments to form the inner sleeve is a slow and expensive process; and too often results in an excessive accumulation of soluble materials such as oil on the wire causing a relatively high scrap rate for these types of hermetic lead wires.

In accordance with the present invention, an improved hermetic lead wire 11 is formed with a thin foil-like inner layer 21 of nonwoven polyester fibers, which will melt to secure the insulation to the wire, but which do not wick varnish and do not require the use of slow speed braiding equipment which also results in accumulation of oil or other soluble material on the internal conductor. In the preferred embodiment of the invention, the inner layer 21 of polyester fibers is on the inner facing side of a dielectric foil or film layer 23, preferably of Mylar. The preferred layers 21 and 23 are bonded together by a thermal adhesive to form a composite, i.e., a laminated tape 27 formed of the layers 21 and 23 which is very thin and very flexible. Additionally, to assure flexibility for the entire wire, which is necessary to prevent breaking of the wire during flexing by vibrations from the motor, the laminated tape 27 is spirally wound about the internal conductor 12 rather than being laid longitudinally of the conductor. Preferably, an overlap is made between successive convolutions of the laminated tape to assure a good dielectric seal, that is, a surrounding impervious wall of dielectric material. Also, as will be explained, the use of the relatively thin tape, for example, 0.002 inch or less, provides a reduced diameter for the hermetic lead wire over the conventional hermetic lead wire having the inner braided Dacron sleeve.

Turning now to the details of the preferred embodiment of the invention, the laminated tape 27 is formed with a preferred cross-sectional thickness of between about 0.0015 0.0025 inch cross-sectional thickness and a width of 0.5 inch. The width of the laminated tape and the thickness may be varied, depending on the requirements, but the flexibility of the tape must be maintained. By way of example only, it is preferred that the nonwoven fibrous Dacron layer 21 be about 0.001 inch in thickness with the thickness of the outer Mylar layer 23 being varied between 0.0005 to 0.0015 inch in cross-sectional thickness. The thickness of the Mylar layer 23 is varied to meet the dielectric strength requirements with the half mil thickness Mylar layer applied spirally with at 57% lap providing a dielectric strength of about 4,500 to 5,000 volts. By doubling the thickness of the Mylar layer from one-half mil to 1 mil in cross-sectional thickness, it has been found that the dielectric strength doubles to about 9,000 to 10,000 volts. For thicker Mylar layers, the thickness or density of the Dacron fibers may be increased.

The preferred Dacron fibers are very fine and laid into a nonwoven mat or web which is then bonded by a thermal adhesive to a wide Mylar web. The composite laminate is then severed into the one-half inch wide tapes 27. As explained above, the density and denier of the fibers may be varied depending on the size of hermetic lead wire being manufactured.

The preferred spiral wrapping of the laminated tape 27 is made with an overlap of about 57 percent which in effect represents a double thickness of the Mylar layer, but still leaves the cable very flexible and of a smaller diameter than that of the conventional hermetic lead wire having the inner Dacron braided sleeve.

The internal conductor 12 is preferably formed of a series of fine copper strands, which are given a slight helical turn, to provide a very flexible conductor which resists breaking with vibration of the motor better than would a solid one-strand internal conductor.

The outer sheath layer 19 of braided Dacron provides the abrasion resistance and strength for the hermetic lead wire 11 and it protects and holds the composite tape in its position about the internal conductor 12. Most other materials which have been used for other wires or cables cannot be used as an outer protective jacket because they would either contaminate the refrigerating fluid or because they are so rigid that they would cause a breaking of the wire with flexing of the lead wire during the flexing by motor vibrations.

The typical sizes for the hermetic lead wires 11 range from 22 AWG to 2.0 AWG although other sizes of such hermetic lead wires maybe constructed in accordance with the principals of the present invention. By way of example and not of limitation, a hermetic lead wire of 14 AWG has been constructed with a central stranded conductor wire of 0.085 inches diameter, a laminated tape 27 of 0.0015 inches cross-sectional thickness having an inner facing layer of nonwoven Dacron fibers and an outer layer 23 of Mylar wound with an overlap of 57 percent to provide an outer diameter of about 0.091 inches for the wound laminated tape 27, and the outer insulating jacket layer 19 of braided Dacron having an outer diameter of 0.105 inches which is the dimension of the outer diameter for the circular cross-sectioned wire 11 of 14 gauge. The dielectric strength of such a hermetic seal wire 11 of 14 gauge has been found to be in excess of 4,500 volts.

From the foregoing, it will be seen that the present invention provides an improved hermetic lead wire which can be constructed at a faster speed because of the elimination of one of the braiding operations to form the inner Dacron sleeve of the conventional hermetic lead wire and with a lower scrap rate due to the reduction of the amount of oil or other soluble materials accumulating on the conductor because of the elimination of the braiding of an inner sleeve. Also, by using nonwoven Dacron fibers, the problem of wicking of the varnish has been substantially eliminated resulting in a more flexible lead wire which does not have a rigid area of hardened varnish after the attached motor has been baked. Although the preferred laminated foil tape is spirally wound, the same may be laid longitudinally with an overlapped seam, the spiral winding providing greater flexibility which is most desirable to resist breaking of vibrations and the like. The above-described insulation of all polyester material is a non-contaminating material for the Freon air conditioning fluid whereas many other plastic materials cannot be used in such an environment without contaminating the Freon air conditioning fluid.

While a preferred embodiment has been shown and described, it will be understood that there is no intent to limit the invention by such disclosure but, rather, it is intended to cover all modifications and alternate constructions falling within the spirit and scope of the invention as defined in the appended claims.

What is claimed is:

1. A hermetic lead wire for use in hermetically sealed electrical apparatus comprising an elongated central flexible conductor having a plurality of metallic strands extending longitudinally of the wire for carrying an electric current, an inner flexible layer of meltable non-woven polyester fibers composed of fiber forming polymers of polyethylene terphthalate surrounding said central stranded conductor and disposed in direct engagement with said central stranded conductor for interlocking with the conductor when melted with a heated stripping tool during the manufacture of said apparatus, an outer flexible layer of plastic film surrounding said inner layer of meltable non-woven polyester fibers and providing a dielectric shield for the wire, said non-woven polyester fibers being secured to and carried by said plastic film layer and being applied to said metallic strands by said plastic film layer, and an outer braided flexible sheath of polyester surrounding said plastic film and providing a protective shield for said plastic film layer.

2. A hermetic lead wire in accordance with claim 1 in which said inner fibrous layer is bonded by an adhesive to said outer plastic film layer and constitutes a laminated tape.

3. A hermetic lead wire in accordance with claim 2 in which said laminated tape is spirally wound about said conductor, said laminated tape having its longitudinal edges overlapping to provide a double thickness of said non-woven polyester fibers and said plastic film.

4. A hermetic lead wire in accordance with claim 1 in which said polyester fibers are in the form of a nonwoven web having a cross-sectional thickness in the order of about 0.005 inch.

5. A hermetic lead wire in accordance with claim 1 in which said outer layer of said laminated tape is a polyethylene terephthalate film having a cross-sectional thickness between about 0.001 inch and 0.002 inch.

6. A hermetic lead wire for connection to an electric motor in a hermetically sealed refrigeration system comprising an elongated central flexible conductor having a plurality of metallic strands extending longitudinally of the wire for carrying an electical current, a helically wound laminated flexible tape surrounding said internal conductor and providing a dielectric shield for the wire, said laminated tape comprising an inner fibrous layer of meltable non-woven polyester fibers composed of fiber forming polymers of polyethylene terephthalate helically disposed about said conductor for interlocking with said conductor when melted by a hot stripping tool and an outer impervious film of plastic helically wrapped about said metallic strands, and an outer flexible braided sheath of polyester surrounding said laminated tape and extending longitudinally of the wire to provide an abrasion resistant sheath for said wire.

* * * * *

UNITED STATES PATENT AND TRADEMARK OFFICE

CERTIFICATE OF CORRECTION

PATENT NO. : 4,045,611

DATED : August 30, 1977

INVENTOR(S) : Duane E. Torgerson

It is certified that error appears in the above-identified patent and that said Letters Patent are hereby corrected as shown below:

Column 1, line 20 "other" should be --outer--.

Column 3, line 4 "0.0015 0.0025" should be --0.0015 to 0.0025--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademarks*